United States Patent [19]

Foss

[11] 4,247,998

[45] Feb. 3, 1981

[54] MACHINE EMBROIDERY HOOP

[76] Inventor: Mildred B. Foss, 22029-196th S.E., Renton, Wash. 98055

[21] Appl. No.: 98,494

[22] Filed: Nov. 29, 1979

[51] Int. Cl.[3] ..... D05C 1/04

[52] U.S. Cl. ..... 38/102.2; 112/103; 112/439

[58] Field of Search ..... 38/102.2; 112/78, 80, 112/103, 439

[56] References Cited

U.S. PATENT DOCUMENTS

| | | | |
|---|---|---|---|
| 669,915 | 3/1901 | Edwards | 38/102.2 |
| 1,072,687 | 9/1913 | Beauregard | 38/102.2 |
| 1,093,136 | 4/1914 | Jucker et al. | 38/102.2 |
| 1,232,940 | 7/1917 | Loeb | 112/439 |
| 1,924,490 | 8/1933 | Fincke | 38/102.2 |
| 1,944,690 | 1/1934 | Karle | 112/103 X |
| 3,596,385 | 8/1971 | Tachibana | 38/102.2 |

*Primary Examiner*—Louis Rimrodt
*Attorney, Agent, or Firm*—Graybeal & Uhlir

[57] ABSTRACT

A pair of embroidery hoops especially adapted to be used with a sewing machine including an inner hoop of fixed diameter and an outer hoop composed of substantially quadrantly related, arcuate hoop segments adjustably interconnected by circumferentially acting screw type connectors, permitting one-handed adjustment of the outer hoop without distortion of the work material. Each of the two hoops is notched along its upper edge to facilitate movement of the hoops under and out from under the presser foot and needle of the sewing machine. Opposed lug members extend inwardly of the inner hoop and provide surfaces to be contacted by the user's thumbs or forefingers for ease of manipulation of the hoops while doing embroidery.

10 Claims, 3 Drawing Figures

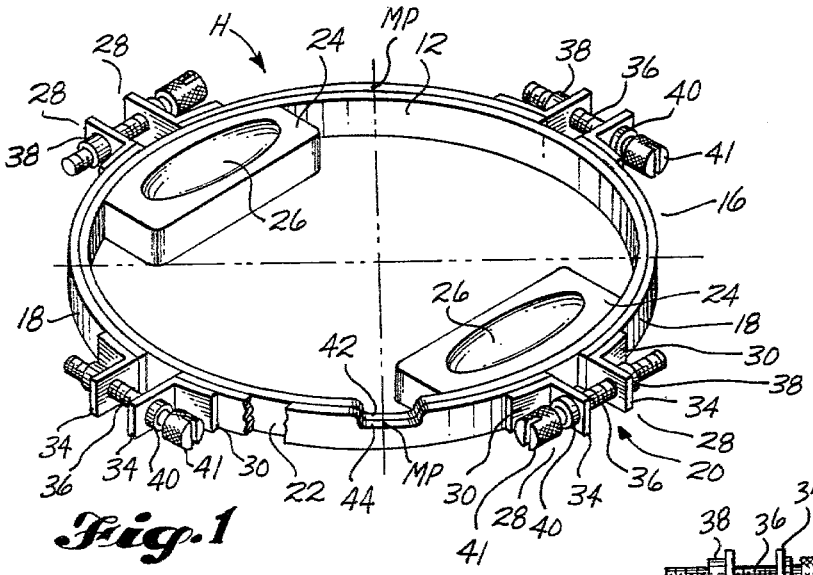
Fig. 1
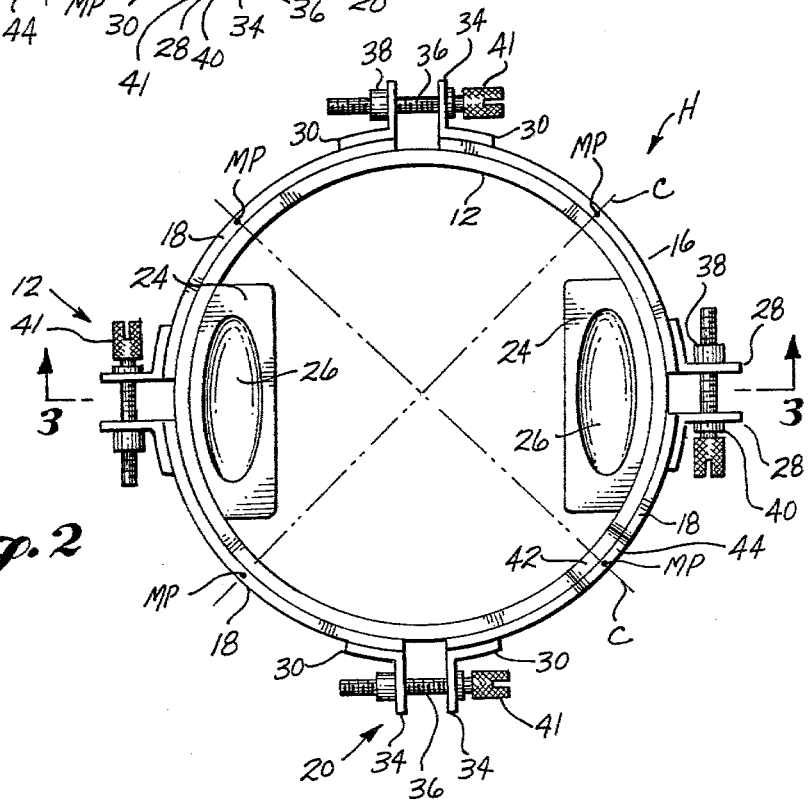
Fig. 2
Fig. 3
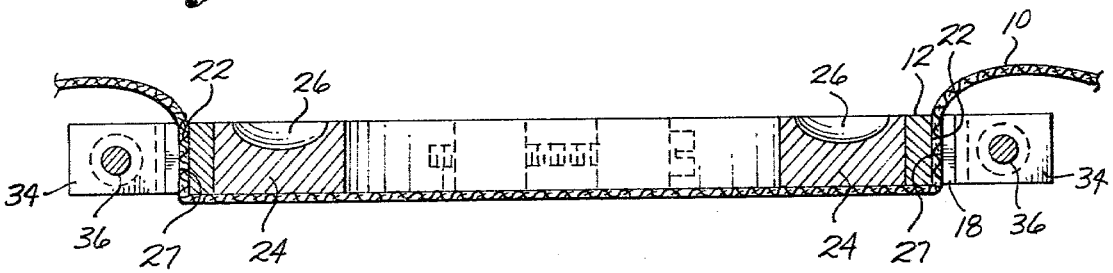

MACHINE EMBROIDERY HOOP

BACKGROUND OF THE INVENTION

1. Field of the Invention

The present invention relates to sewing accessories, and in particular to new embroidery hoops especially adapted for use with a sewing machine.

2. Description of the Prior Art

The design of existing embroidery hoops has reflected the fact that until recently, almost all handicraft embroidery sewing has been done manually. Generally the work piece is held by a pair of concentric, closely fitting hoops, with the work piece overlying the inner hoop and clamped along its margin between the inner and outer hoops. Perhaps the simplest type of known embroidery hoops consist of two fixed diameter hoops adapted to fit one within the other. The inner hoop is formed with an outside diameter slightly smaller than the inside diameter of the outer hoop to enable the hoops to clamp the work therebetween. However, with this form of hoops, and because the diameter of neither hoop can be adjusted, thin materials cannot be maintained taut while thick materials cannot fit between the two hoops.

In another type of hoop pair designed for manual embroidery stitching, the inner hoop is of a fixed diameter while the outer hoop is slit to permit it to expand and contract. Typically, a circumferentially acting, screw type fastener interconnects the end portions of the outer hoop to loosen and tighten the outer hoop over the inner hoop. Although this particular type of construction enables the embroidery hoops to accommodate varying thicknesses of materials, when the connecting screw is tightened, the fabric work piece is often distorted and thus not held uniformly taut by the hoops. An example of embroidery hoops of this type is disclosed by Beauregard, U.S. Pat. No. 1,072,687.

Another type of adjustable embroidery hoops utilizes a fixed diameter inner hoop and a plurality of outer hoop segments which are each adapted to move radially toward and away from the inner diameter hoop to clamp a work piece therebetween. Each of the outer diameter hoop segments is carried by a radially disposed thumb screw which seats within an outer circular ring which encircles the hoop segments. Because the thumb screws act in the radial direction rather than circumferentially, the fabric clamped between the two hoops may be unequally gripped thus causing the fabric to slip or shift during sewing. Furthermore, adjustment of the thumb screws, which are situated under a wide circumferential flange, extending radially outwardly from the outer circular ring, is awkward and extreme care must be taken to adjust each of the thumb screws so that each outer segment exerts an equal amount of pressure against the fixed inner hoop or else the inner hoop may be overstressed and permanently deformed out of shape rendering it no longer usable. The wide circumferential flange also limits and impedes movement of the hoop if machine embroidery is attempted with such a hoop. An embroidery hoop pair of this type is disclosed by Edwards, U.S. Pat. No. 669,915.

The advent of modern sewing machines, with the capability of sewing many different types of stitches in addition to the standard straight stitch, has greatly increased the desirability of using sewing machines to do embroidery work. Newer sewing machines are not only capable of producing a uniform, high quality stitch, but also are capable of sewing many times faster than possible by hand. However, all of the different types of prior hoops discussed above have characteristics limiting their utility if used for embroidery work on a sewing machine. No provision is made in any of the hoops to facilitate sliding them and the work between the machine bed and the foot or needle of the machine. Also, none of the earlier described types of hoops include any provision to enable the user to grip them so that they can be quickly, conveniently and continuously maneuvered to take advantage of the high speed at which a machine sews. Accordingly, it is a primary object of the present invention to provide embroidery hoops especially adapted in these respects for use in conjunction with a modern sewing machine.

SUMMARY OF THE INVENTION

The present invention relates to novel machine embroidery hoops which, in basic form, are characterized by a fixed diameter inner hoop and a segmentally adjustable diameter outer hoop. The inner hoop is formed in the shape of a band surrounded by four arcuate segments which cooperate to form the outer hoop. Circumferentially acting, manually adjustable screw connectors, disposed substantially coplanar with the outer hoop segments, interconnect the adjacent end portions of adjacent segments to permit the diameter of the outer hoop to be varied. The screw connectors are advantageously orientated so that they may be manipulated by only one hand while the hoops are grasped by the other.

According to another aspect of the present invention, the inner and outer hoops are notched or recessed along corresponding upper edges to permit the hoops to conveniently slide under a sewing machine needle and foot. As a consequence, the needle and foot do not have to be removed each time the hoops are placed beneath or removed from the machine.

According to a further aspect of the present invention, guides are provided to permit the hoops to be conveniently grasped and guided by the user, especially when sewing with a machine. The guides typically are in the form of a pair of diametrically opposed lug members fixedly attached along the inside diameter of inner hoop. The lug members each include an upwardly open depression for receiving and supporting portions of the user's thumb or finger for convenient gripping of the hoops.

It is a primary object of the present invention to provide embroidery hoops especially adapted to be used in conjunction with sewing machines but which may also be used when stitching by hand.

It is another object of the present invention to provide embroidery hoops which are capable of conveniently passing beneath the foot and needle of the machine without requiring partial disassembly of the machine.

It is a still further object of the present invention to provide embroidery hoops which may be conveniently gripped by the user to manuever the hoops beneath a sewing machine needle and foot.

Yet another object of the present invention is to provide embroidery hoops which are readily capable of accommodating different thicknesses of materials and also which enable the material to be easily clamped and maintained in taut condition without being distorted.

An additional object of the present invention is to provide machine embroidery hoops capable of holding very smooth and/or thin work materials evenly taut.

Still a further object of the present invention is to provide machine embroidery hoops having an outer band which may be segmentably adjusted in size with the use of only one hand while the hoops are held by the other hand.

BRIEF DESCRIPTION OF THE DRAWINGS

FIG. 1 is an isometric view of one typical embodiment of the present invention;

FIG. 2 is a plan view of the typical embroidery hoop shown in FIG. 1; and FIG. 3 is an enlarged cross-sectional view of the typical embroidery hoop shown in FIG. 2, taken substantially alongs lines 3—3 thereof.

DESCRIPTION OF THE PREFERRED EMBODIMENT

Referring initially to FIG. 3, a fabric work piece 10 is stretched over the inner hoop 12 of a pair of hoops, generally indicated at H, and held in position by an adjustable outer hoop 16 composed of four hoop segments 18 joined together by connectors 20. Additionally referring to FIGS. 1 and 2, inner hoop 12 is formed in the shape of a relatively thin band having a generally rectangular cross section. The outer surface of inner hoop 12 is preferably overlaid with twill tape 22 or the like to establish frictional contact between inner hoop 12 and work piece 10 to prevent the work piece from shifting or becoming loosened. However, rather than utilizing twill tape 22, the outer surface of inner hoop 12 can be instead knurled or even overlaid with rubber to facilitate the holding of work piece 10 taut across the inner hoop 16.

For aesthetic reasons inner hoop 12 is preferably formed from hardwood material. However, for economy of construction, hoop 12 can also be fabricated of metallic or plastic materials.

Referring to FIGS. 1–3, embroidery hoops H also include guides for aiding the user to maneuver the work piece over a sewing machine bed relative to the sewing needle. In a typical embodiment of the present invention, the guides include a pair of generally elongate lugs or tabs 24 fixedly attached along the inside diameter of inner hoop 12 in generally diametrically opposed relationship to each other. The tabs 24 may be integrally part of, or fixed to, inner hoop 12 by any convenient means such as by welding, gluing or riveting. The outer edge of each lug 24 extends along an arc corresponding to the inside diameter of inner hoop 12, while the inner edges of lugs 24 are disposed generally parallel to each other. Preferably, the width of each lug 24 is kept to a practical minimum to maximize an open area within inner hoop 12. As perhaps best illustrated in FIGS. 1 and 3, each lug 24 is preferably formed with an elongate, upwardly open, oval shaped depression 26 contoured and sized to conveniently receive and support the thumbs or fingertips to permit the user to conveniently guide the hoops while the machine is stitching.

Referring particularly to FIGS. 1 and 3, outer hoop 16 is constructed from four arcuate, preferably substantially identical hoop segments 18 adjustably interconnected by connectors 20 to form a generally continuous band or ring shape. Each hoop segment 18 is rectangular in cross section to define a transversely flat inner diameter surface 27 closely corresponding to the outer diameter surface 22 of inner hoop 12. As best illustrated in FIGS. 1 and 2, hoop segments 18 are quadrantly arranged in two sets of two segments each. The two segments of each set are diametrically opposed from each other to each occupy one quadrant of the circumference of outer hoop 16. Accordingly, chords C which intersect the midpoints MP of each set of segments 18 are disposed perpendicularly to each other. Preferably hoop segments 18 are ideally constructed from hardwood, but may be formed from other materials, such as metal or plastic.

Connectors 20, which adjustably interconnect adjacent hoop segments 18, include a pair of angle brackets 28 each having an arcuate first leg 30 overlapping a portion of the outside surface of each hoop segment 18 and fastened thereto by any convenient manner. Each angle bracket 28 also includes a straight second leg 34 extending substantially radially outwardly from the corresponding end of a hoop segment 18 to lie parallel to the radial leg of the opposite angle bracket 28 of each connector 20. Ideally the width of brackets 28 should not extend beyond the top and bottom edges of hoops 12 and 16 to permit work piece 10 to lie on top of the bed of the sewing machine and to enable the marginal portions of piece 10 to evenly and smoothly overlie the upper edge of outer hoop 16.

Aligned through holes are provided in radial legs 34 of each pair of angle brackets 28 to slidably receive therethrough an externally threaded screw 36 engagable with an internally threaded nut 38 affixed to the surface of each bracket radial leg 34 adjacent the tip of screw 36. Each screw 36 includes a circular shoulder or seat 40 which bears against the outside surface of a corresponding bracket radial leg 34 adjacent the head of the screw. Preferably the head 41 of each screw 36 is grooved or knurled to enable the user to conveniently grip and twist the screw 36 when adjusting the diameter of outer hoop 16. Also, a slot is formed in the end of head 41 to accept the blade of a screwdriver or similar tool to, for instance, loosen screw 36 if it ever is tightened beyond the capacity of the user to loosen it.

Preferably the through holes in brackets 28 are vertically centrally located and the maximum diameter of shoulder 40 and head 41 of screws 36 are no larger than the width of hoops 12 and 16 to prevent screws 36 from interfering with free movement of hoop pair H by bottoming on the bed of the sewing machine. Also preferably, three of the screws are aligned in the same direction about the circumference of outer hoop 16 while the fourth screw is aligned in the opposite direction. Orientating screws 36 in this manner permits all of them to be easily reached for adjustment by only one hand while the other hand is used to grasp hoop pair H at a location between the two screws 36 facing oppositely of each other. It will be appreciated that orientating screws 36 so that they act in the circumferential direction enables them to adjust the size of outer hoop 16 while applying a uniform clamping force on inner hoop 12.

In preferred form, brackets 28 are formed from a relatively high strength structure material capable of carrying the bending loads imposed thereon when screws 36 are tightened. Also, rather than making hoop segments 18 and angle brackets 28 from separate pieces, these two components can be combined into an integral structure, for instance, by increasing the length of each hoop segment and bending its end portions outwardly to assume the location occupied by bracket radial legs 34.

Next, referring specifically to FIG. 1, the upper edges of inner hoop 12 and outer hoop 16 are notched at 42 and 44, respectively, to form a U-shaped depression enabling hoop pair H to pass beneath the foot and needle of a sewing machine, not shown. It has been applicant's experience that conventional embroidery hoops are often too wide to pass beneath the needle and foot of the machine even when the needle and foot are placed in their fully retracted positions.

Notches 42 and 44 are dimensionally of a depth about half the width of the hoops 12 and 16, are minimal in circumferential length, and are substantially aligned with each other, consistent with the purpose thereof, that of facilitating passage of the hoops beneath the foot and needle of a sewing machine, without loss of adequate strength of the hoops 12 and 16. As will be noted in FIG. 3, the notches 42 and 44, being situated on the upper edge of the hoops 12 and 16, do not impair the capability of the hoops 12 and 16 in terms of maintaining the work material 10 evenly taut since the material 10 is stretched across the unnotched lower edge of the inner hoop 12.

To clamp the work material 10 between inner hoop 12 and outer hoop 16, screws 36 are each retracted a uniform distance to create a gap between the inner and outer hoops of a width large enough to permit the work piece to fit therebetween. With inner hoop 12 removed, the work 10 is placed over the upper edge of outer hoop 16 and then inner hoop 12 is inserted downwardly within the outer hoop making sure that notches 42 and 44 are aligned with each other. As illustrated in FIG. 3, work material 10, when held by hoop pair H, is disposed below the lower edge of inner hoop 12 and above the upper edge of outer hoop 16, with the finished surface facing upwardly. Next, screws 36 are progressively tightened to marginally clamp the work area of the work material 10 between inner and outer hoops 12 and 16. Before outer hoop segment 18 is drawn tightly around inner hoop 12, the portions of work piece 10 extending upwardly above said hoops may be pulled in appropriate direction to evenly stretch the work piece taut. However, if outer hoop 16 is initially loosened just enough to permit work piece 10 to smoothly fit between the outer hoop and inner hoop, subsequent stretching of the work piece may not be required.

Applicant has found that constructing outer hoop 16 from four segments 18, equally spaced apart about the circumference of the inner hoop 12, enables the hoop pair H to evenly and securely clamp work piece 10 without causing the work piece to shift or gather at one location as often occurs when a conventional outer hoop having a single adjusting screw is tightened. When one screw 36 is tightened, the adjacent portion of work piece 10 may tend to gather initially, but by next tightening the two adjacent screws, the initial gather is stretched out so that the work piece resumes its original smooth shape. Thus, if work piece 10 is placed over outer hoops 16 with its warp and weft threads in straight lines, perpendicular to each other, the warp and weft will remain straight when outer hoop 16 is tightened by evenly slightly tightening each screw 36 successively in sequence.

The hoop pair H may next be slid into place by passing notches 42 and 44 beneath the needle and foot of the sewing machine. Hoop pair H can be conveniently held during stitching by placing the sides of the thumbs within lug depressions 26 and the tips of the fingers around the portions of the outer circumference of outer hoop 16 facing away from the user. In this manner, a fabric work piece 10 may be conveniently guided relative to the sewing machine needle.

Alternatively, embroidery hoop pair H can be grasped by placing the tips of the forefingers on each lug depression 26 and then placing the thumbs towards each other and against the outer circumference of outer hoop 16 so that the hands are located on the side of embroidery hoop pair H facing the user. Regardless of the particular method used to hold hoop pair H, it will be appreciated that lugs 24, by serving as a rest for either the thumbs or forefingers, contributes to the ease with which hoop pair H can be slid about the bed of the sewing machine. This is important since a sewing machine can be only fully utilized to embroider if the fabric work piece can be guided easily and quickly enough to take advantage of the high speed of the machine.

To remove the work piece, hoop pair H is first removed from the sewing machine by passing notches 42 and 44 beneath the retracted needle and foot of the machine. Next, screws 36 are simply loosened.

It will be appreciated that although hoop pair H is especially adapted to be used in conjunction with a modern sewing machine, it can also be used to do manual, i.e. hand embroidery. Furthermore, the adjustability of the size of outer hoop 16 permits different thicknesses of fabric to be accomodated without being distorted or twisted when outer hoop 16 is tightened about inner hoop 12.

The invention may be embodied in other specific forms without departing from the spirit or essential characteristics thereof. The present embodiments are therefore to be considered in all respects as illustrative and not restrictive, the scope of the invention being set forth in the appended claims rather than being limited to the specific embodiments described in the foregoing description.

What is claimed is:

1. Machine embroidery hoops for stitching a piece of fabric therebetween, said hoops comprising a circularly shaped, fixed diameter inner hoop; an outer hoop having two pairs of substantially diametrically opposed, arcuate hoop segments quadrantly arranged around the circumference of said inner hoop to define a circular shape; and circumferentially acting, expandable and contractable connecting means for interconnecting the adjacent end portions of said adjacent outer hoop segments to vary the inside diameter of said outer hoop in selective fixed diameters, from a size larger than the outside diameter of said inner hoop to a size tightly clamping said outer hoop upon said inner hoop to thereby securely hold fabrics of varying thickness between said inner and outer hoops.

2. Machine embroidery hoops according to claim 1, wherein the arc length of each of said four outer hoop segments is substantially equal.

3. Machine embroidery hoops according to claim 2, wherein each of said four outer hoop segments define an arc of slightly less than 90°.

4. Machine embroidery hoops according to claim 1, wherein the outer diameter of said inner hoop includes a friction gripping surface.

5. Machine embroidery hoops according to claim 4, wherein said friction gripping surface includes twill tape material.

6. Machine embroidery hoops according to claim 4, wherein said friction gripping surface is formed integrally with said inner hoop.

7. Machine embroidery hoops according to claim 6, wherein the gripping surface includes a plurality of serrations.

8. Machine embroidery hoops according to claim 1, wherein said connecting means includes a horizontally disposed, threaded screw connector disposed tangentially to the outer surfaces of, and between, each two angularly adjacent outer hoop segments, each of said screw connectors vertically positioned relative to said outer hoop segments to lie above the lower edges and below the upper edges of said corresponding outer hoop segments.

9. Machine embroidery hoops according to claim 1, further including guide means extending radially inwardly from said inner hoop at an elevation above the fabric stretched by said hoops for manually guiding said hoops with a user's fingers.

10. Machine embroidery hoops according to claim 9, wherein said guide means includes a pair of lug members fixedly attached along the inside diameter of said inner hoop to extend inwardly from said inner hoop, each of said lug members having a downwardly extending depression for receiving portions of a finger or a thumb.

* * * * *